US008668553B2

(12) United States Patent
Korogi

(10) Patent No.: US 8,668,553 B2
(45) Date of Patent: Mar. 11, 2014

(54) METHOD OF MANUFACTURING SEMICONDUCTOR DEVICE

(75) Inventor: Hayato Korogi, Toyama (JP)

(73) Assignee: Panasonic Corporation, Osaka (JP)

( * ) Notice: Subject to any disclaimer, the term of this patent is extended or adjusted under 35 U.S.C. 154(b) by 269 days.

(21) Appl. No.: 13/038,821

(22) Filed: Mar. 2, 2011

(65) Prior Publication Data

US 2011/0151751 A1 Jun. 23, 2011

Related U.S. Application Data

(63) Continuation of application No. PCT/JP2009/005666, filed on Oct. 27, 2009.

(30) Foreign Application Priority Data

Jan. 14, 2009 (JP) ..... 2009-005460

(51) Int. Cl.
*B24B 1/00* (2006.01)

(52) U.S. Cl.
USPC ..... 451/41; 451/54; 451/57; 451/287; 438/692

(58) Field of Classification Search
USPC ..... 451/41, 54, 57, 59, 63, 285, 287, 288; 438/692; 156/345.12
See application file for complete search history.

(56) References Cited

U.S. PATENT DOCUMENTS

| | | | | |
|---|---|---|---|---|
| 6,565,422 | B1 | 5/2003 | Homma et al. | |
| 7,172,963 | B2 * | 2/2007 | Yamada et al. | 438/626 |
| 8,075,372 | B2 * | 12/2011 | Prasad | 451/59 |
| 2005/0003670 | A1 * | 1/2005 | Yamada et al. | 438/692 |
| 2005/0034999 | A1 * | 2/2005 | Lee et al. | 205/640 |
| 2006/0046622 | A1 * | 3/2006 | Prasad | 451/41 |
| 2010/0136372 | A1 * | 6/2010 | Ishida et al. | 428/846.9 |

FOREIGN PATENT DOCUMENTS

| | | |
|---|---|---|
| JP | 2000-237952 | 9/2000 |
| JP | 2002-075933 | 3/2002 |
| JP | 2005-26538 | 1/2005 |
| JP | 2006-140240 | 6/2006 |
| WO | WO 2007/060869 A1 | 5/2007 |

* cited by examiner

*Primary Examiner* — Eileen P. Morgan
(74) *Attorney, Agent, or Firm* — McDermott Will & Emery LLP

(57) ABSTRACT

A method for manufacturing a semiconductor device includes the step of polishing a conductive film formed over a semiconductor substrate. The conductive film is formed by a barrier film that is in contact with second and third interlayer insulating films, and a copper film that is in contact with the barrier film. A polishing surface of a second polishing pad for polishing and removing the barrier film and the third interlayer insulating film has a lower pore area ratio than a polishing surface of a first polishing pad for polishing and removing the copper film.

10 Claims, 8 Drawing Sheets

METHOD OF MANUFACTURING SEMICONDUCTOR DEVICE

CROSS-REFERENCE TO RELATED APPLICATION

This is a continuation of PCT International Application PCT/JP2009/005666 filed on Oct. 27, 2009, which claims priority to Japanese Patent Application No. 2009-5460 filed on Jan. 14, 2009. The disclosures of these applications including the specifications, the drawings, and the claims are hereby incorporated by reference in their entirety.

BACKGROUND

The present invention relates to methods of manufacturing a semiconductor device, and more particularly to methods of manufacturing a semiconductor device, which include a polishing method that is used to form an insulating film or to form interconnects in the insulating film.

With recent miniaturization of semiconductor devices, the intervals between elements and between interconnects connecting the elements have been increasingly reduced. Such reduced intervals have caused problems such as increased capacitance between interconnects and a reduced signal propagation speed. In order to solve these problems and to achieve higher speed operation and lower power consumption, insulating films having a low relative dielectric constant have been used as interlayer films. However, since the insulating films having a low relative dielectric constant have low hardness, scratches are made by chemical mechanical polishing (CMP) that is performed to form interconnects. This reduces manufacturing yield and reliability due to short-circuits between the interconnects.

As a solution to this problem, a method of reducing scratches has been considered as described in Japanese Patent Publication No. 2002-075933. A polishing pad shown in Japanese Patent Publication No. 2002-075933 will be described below with reference to FIG. 8.

As shown in FIG. 8, Japanese Patent Publication No. 2002-075933 discloses a semiconductor wafer polishing pad that is formed by stacking together a porous elastic resin layer 1, a resin layer (a second layer) 2, and a layer (a third layer) 3. The porous elastic resin layer 1 is an outermost layer and serves as a polishing layer. The second layer 2 adjoins the porous elastic resin layer 1, and has a higher elastic modulus than the porous elastic resin layer 1. The third layer 3 is located on the opposite side of the second layer 2 from the porous elastic resin layer 1, and is sufficiently softer than the second layer 2.

SUMMARY

However, the technique of Japanese Patent Publication No. 2002-075933 has the following problem. As shown in FIG. 9A, during polishing with a polishing pad 702 described in Japanese Patent Publication No. 2002-075933, abrasive particles 704 contained in a polishing slurry are agglomerated in pores 703 that are present in the porous elastic resin as the outermost layer (705). As shown in FIG. 9B, the agglomerated abrasive particles 705 scratch a polished film 701, and such scratches 706 reduce the manufacturing yield and reliability of semiconductor devices.

Thus, it is an object of the present invention to prevent scratches on a polished film during polishing in a manufacturing method of a semiconductor device, thereby increasing the manufacturing yield and reliability of semiconductor devices.

In order to achieve the above object, a first method for manufacturing a semiconductor device according to the present invention includes the step of polishing a conductive film formed over a semiconductor substrate. The conductive film is formed by a barrier film that is in contact with an insulating film, and a metal film that is in contact with the barrier film. A polishing surface of a second polishing pad for polishing and removing the barrier film and the insulating film has a lower pore area ratio than a polishing surface of a first polishing pad for polishing and removing the metal film.

According to the first method of the present invention, the polishing surface of the second polishing pad for polishing and removing the barrier film and the insulating film has a lower pore area ratio than the polishing surface of the first polishing pad for polishing and removing the metal film. Thus, the number of abrasive particles is reduced which are agglomerated in pores of the second polishing pad during polishing with the second polishing pad. Since the number of abrasive particles agglomerated in the pores is reduced, scratches on the insulating film can be prevented.

In the first method of the present invention, it is preferable that the pore area ratio of the polishing surface of the second polishing pad be between 10 percent and "23×(hardness [GPa] of the insulating film) ^ 1.2" percent, both inclusive. The use of such a polishing pad can prevent scratches, whereby reliable semiconductor devices can be manufactured.

In the first method of the present invention, it is preferable that the pore area ratio of the polishing surface of the first polishing pad be between "23×(hardness [GPa] of the insulating film) ^ 1.2" percent and 90 percent, both inclusive. The use of such a polishing pad reduces wear of the polishing pad, whereby semiconductor devices can be manufactured at low cost.

In the first method of the present invention, it is preferable to use an insulating film having a relative dielectric constant of 3.0 or less, or less than 3.0 as the insulating film. The use of a low dielectric constant (low-k) film having a relative dielectric constant of 3.0 or less, or less than 3.0 reduces capacitance between interconnects, whereby semiconductor devices capable of operating at a high speed with low power consumption can be manufactured.

In the first method of the present invention, it is preferable that the insulating film be formed by a first insulating film having a relative dielectric constant of more than 3.0 as an upper layer, and a second insulating film having a relative dielectric constant of 3.0 or less, or less than 3.0 as a lower layer. Forming the insulating film having a high relative dielectric constant as the upper layer can reduce processing damage, such as damage that is caused when depositing a mask such as a hard mask or a resist mask, and damage that is caused when depositing a barrier metal film.

In the first method of the present invention, it is preferable to polish and remove the entire first insulating film in the polishing of the insulating film. Removing the insulating film having a high relative dielectric constant can further reduce the capacitance between interconnects.

In order to achieve the above object, a second method for manufacturing a semiconductor device according to the present invention includes the step of polishing an insulating film formed over a semiconductor substrate. The step of polishing the insulating film includes a first polishing step and a second polishing step. A polishing surface of a second polishing pad for polishing and removing the insulating film in the second polishing step has a lower pore area ratio than a polishing surface of a first polishing pad for polishing and removing the insulating film in the first polishing step.

According to the second method of the present invention, the polishing surface of the second polishing pad for polishing and removing the insulating film in the second polishing step has a lower pore area ratio than the polishing surface of the first polishing pad for polishing and removing the insulating film in the first polishing step. Thus, the number of abrasive particles is reduced which are agglomerated in pores of the second polishing pad during polishing with the second polishing pad. Since the number of abrasive particles agglomerated in the pores is reduced, the polishing rate can be maintained by the first polishing step, and scratches on the insulating film can be prevented by the second polishing step.

In the second method of the present invention, it is preferable that the pore area ratio of the polishing surface of the second polishing pad be between 10 percent and "23×(hardness [GPa] of the insulating film) ^1.2" percent, both inclusive. The use of such a polishing pad can prevent scratches, whereby reliable semiconductor devices can be manufactured.

In the second method of the present invention, it is preferable that the pore area ratio of the polishing surface of the first polishing pad be between "23×(hardness [GPa] of the insulating film) ^1.2" percent and 90 percent, both inclusive. The use of such a polishing pad reduces wear of the polishing pad, whereby semiconductor devices can be manufactured at low cost.

In the second method of the present invention, it is preferable that the insulating film be an insulating film having a relative dielectric constant of 3.0 or less, or less than 3.0. The use of a low-k film having a relative dielectric constant of 3.0 or less, or less than 3.0 reduces capacitance between interconnects, whereby semiconductor devices capable of operating at a high speed with low power consumption can be manufactured.

It should be understood that the above features can be combined as appropriate within the scope of the present invention. Even if each feature can be expected to provide a plurality of advantages, the feature need not necessarily be capable of providing all of the advantages.

Since the method for manufacturing a semiconductor device according to the present invention can prevent scratches on a low-k film having low hardness, manufacturing yield and reliability of semiconductor devices can be increased.

DETAILED DESCRIPTION

Methods for manufacturing a semiconductor device according to embodiments of the present invention will be described below with reference to the accompanying drawings. The drawings, the shapes, materials, and dimensions of various components, etc. which are shown and described herein are merely given as desirable examples, and are not limited to the details provided. Various modifications and changes can be made as appropriate without departing from the scope of the present invention.

First Embodiment

FIGS. 1A-1I and 2A-2D show cross-sectional configurations, sequentially illustrating the steps of a main part of a method for manufacturing a semiconductor device according to a first embodiment of the present invention.

Figure 1A:
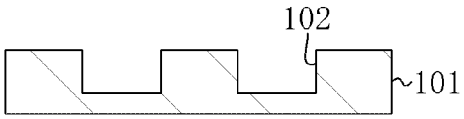
FIGS. 1A-1I are cross-sectional views illustrating the steps of a method for manufacturing a semiconductor device according to a first embodiment.

First, as shown in FIG. 1A, a first interlayer insulating film 101 having a thickness of about 200 nm is deposited over a semiconductor substrate (not shown) having a plurality of semiconductor elements formed thereon, by using, e.g., a chemical vapor deposition (CVD) method. The semiconductor substrate is made of silicon (Si), and the first interlayer insulating film 101 is made of carbon-doped silicon oxide (SiOC). Next, a plurality of first grooves 102 for forming interconnects (hereinafter referred to as the "first interconnect formation grooves 102") are formed in the first interlayer insulating film 101 so as to be separated from each other, by using a lithography method and a dry etching method.

Figure 1B:
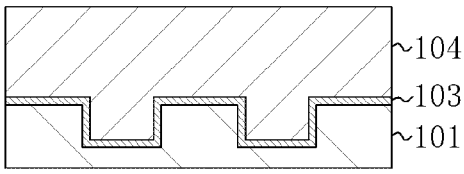

Then, as shown in FIG. 1B, a tantalum (Ta)/tantalum nitride (TaN) barrier film 103 and a copper film 104 are sequentially deposited over the entire surface of the first interlayer insulating film 101 including the first interconnect formation grooves 102, by using a sputtering method and a plating method. Note that although the stacked film of Ta and TaN films is used as the barrier film 103 in the present embodiment, a single-layer film or a stacked film, which is made of a Ta film, a titanium (Ti) film, a ruthenium (Ru) film, nitride films or alloys thereof, etc., may be used as the barrier film 103. Although copper (Cu) is used as a conductive film that is embedded in the first interconnect formation grooves 102, the present invention is not limited to copper, and silver (Ag), aluminum (Al), alloys thereof, etc. may be used as the conductive film.

Figure 1C:
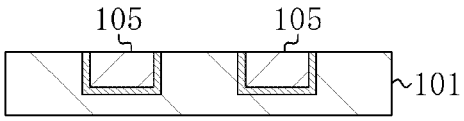

As shown in FIG. 1C, unwanted parts of the barrier film 103 and the copper film 104, which are deposited in the region other than the first interconnect formation grooves 102 over the first interlayer insulating film 101, are removed by using a chemical mechanical polishing (CMP) method. Thus, first interconnects 105, which are formed by the barrier film 103 and the copper film 104, are formed in the first interconnect formation grooves 102.

Figure 1D:
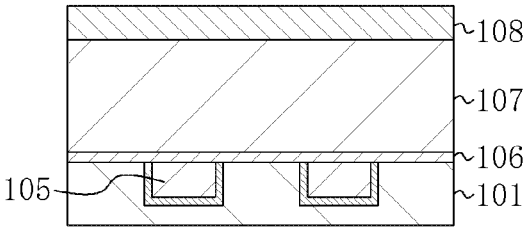

As shown in FIG. 1D, a first liner film 106, which is made of nitride-doped silicon carbide (SiCN) and has a thickness of about 50 nm, is formed over the entire surface including the first interlayer insulating film 101 and the first interconnects 105, by using, e.g., a CVD method. Then, a second interlayer insulating film 107, which is made of SiOC and has a thickness of about 200 nm, is formed on the first liner film 106. Subsequently, a third interlayer insulating film 108, which is made of silicon dioxide ($SiO_2$) and has a thickness of about 100 nm, is formed on the second interlayer insulating film 107. Note that in the present embodiment, a SiOC film having a relative dielectric constant of about 3.0 or less, or a SiOC film having a relative dielectric constant of less than about 3.0 and including pores is preferably used as the second interlayer insulating film 107 made of SiOC. The lower the relative dielectric constant of the second interlayer insulating film 107 is, the more the capacitance between interconnects can be reduced. Thus, higher speed operation and lower power consumption of semiconductor devices can be implemented. Although the third interlayer insulating film 108 made of $SiO_2$ is used in the present embodiment, the third interlayer insulating film 108 may be an insulating film made of SiOC having a relative dielectric constant of about 3.0 or more, or a stacked film of $SiO_2$ and SiOC. When used as a hard mask for processing, the third interlayer insulating film 108 made of $SiO_2$ may be a stacked film that is formed by stacking a metal film such as TiN or TaN on an insulating film made of $SiO_2$ or SiOC.

Figure 1E:
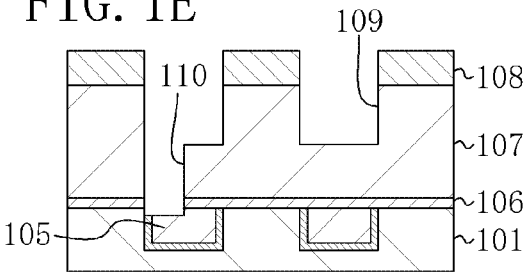

As shown in FIG. 1E, second grooves 109 for forming interconnects (hereinafter referred to as the "second interconnect formation grooves 109") are formed in the second interlayer insulating film 107 and the third interlayer insulating film 108 by using a lithography method and a dry etching method. Then, a first hole 110 for forming a via (hereinafter referred to as the "first via formation hole 110") connecting to the first interconnect 105 is formed in the first liner film 106 and the second interlayer insulating film 107 by using a lithography method and a dry etching method.

Figure 1F:
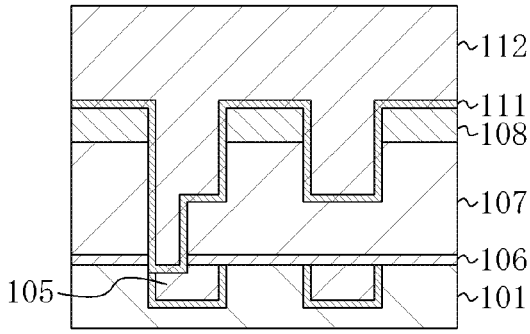

As shown in FIG. 1F, a Ta/TaN barrier film 111 and a copper film 112 are sequentially deposited over the entire surface of the third interlayer insulating film 108 including the second interconnect formation grooves 109 and the first via formation hole 110, by using a sputtering method and a plating method. Note that although the stacked film of the Ta and TaN films is used as the barrier film 111 in the present embodiment, a single-layer film or a stacked film, which is made of a Ta film, a Ti film, a Ru film, nitride films or alloys thereof, etc. may be used as the barrier film 111. Although copper (Cu) is used as a conductive film that is embedded in the second interconnect formation grooves 109 and the first via formation hole 110, the present invention is not limited to Cu, and silver (Ag), aluminum (Al), alloys thereof, etc. may be used as the conductive film.

Figure 1G:
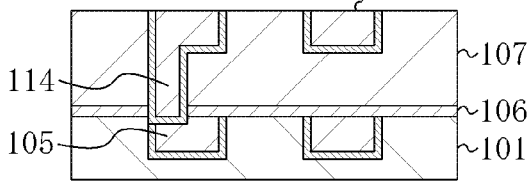

As shown in FIG. 1G, unwanted parts of the barrier film 111 and the copper film 112, which are deposited in the region other than the second interconnect formation grooves 109 over the third interlayer insulating film 108, and the third interlayer insulating film 108 are removed by using a CMP method, and the second interlayer insulating film 107 is polished by a thickness of about 20 nm. Thus, second interconnects 113 and a first via 114, which are formed by the barrier film 111 and the copper film 112, are formed in the second interconnect formation grooves 109 and the first via formation hole 110. The CMP method shown in FIG. 1G will be described in detail later with reference to FIGS. 3A-3D.

Figure 1H:
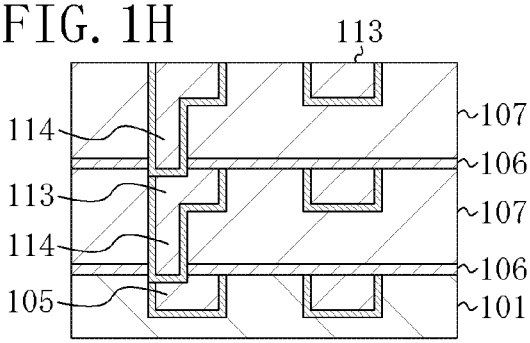

Subsequently, the steps of FIGS. 1D-1G are repeated to form a three-layer interconnect structure shown in FIG. 1H. Note that although the three-layer interconnect structure is formed by repeating the steps of FIGS. 1D-1G in the present embodiment, the number of interconnect layers of the interconnect structure is not limited to this.

Figure 1I:
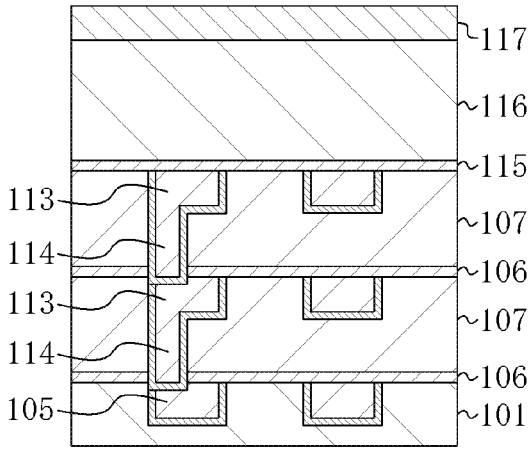

Thereafter, as shown in FIG. 1I, a second liner film 115, which is made of SiCN and has a thickness of about 60 nm, is formed on the entire surface of the interconnect structure by using, e.g., a CVD method. Then, a fourth interlayer insulating film 116, which is made of SiOC having a relative dielectric constant of about 3.0 or more, or more than about 3.0, is formed with a thickness of about 400 nm on the second liner film 115. Subsequently, a fifth interlayer insulating film 117, which is made of $SiO_2$ and has a thickness of about 100 nm, is formed on the fourth interlayer insulating film 116. Note that although SiCN is used as the second liner film 115 in the present embodiment, silicon nitride (SiN) may be used as the second liner film 115. In the three-layer structure shown in FIG. 1H, interlayer insulating films having a low relative dielectric constant are required for the interconnects in the upper two layers in order to implement higher speed operation and lower power consumption. However, any interconnects capable of stably supplying electric power can be used as the interconnects in layers located higher than the upper two layers, and interlayer insulating films having a low relative dielectric constant need not necessarily be used. Note that in the present embodiment, the interlayer insulating films having a low relative dielectric constant are used for the upper two layers of the three-layer structure. However, insulating films having a low relative dielectric constant may be used as the interlayer insulating films of two or more layers, because changes are made as appropriate according to the required specifications of the semiconductor devices.

Figure 2A:
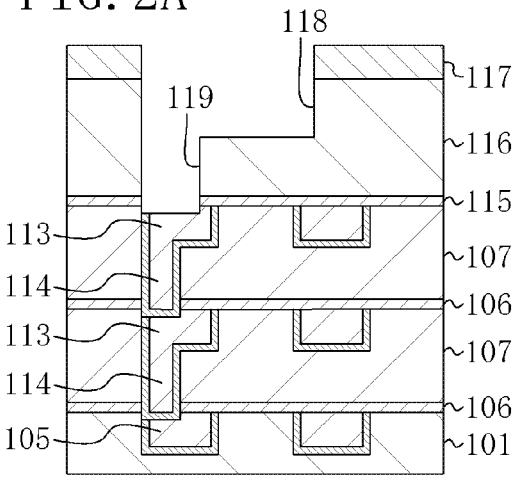
FIGS. 2A-2D are cross-sectional views illustrating the steps of the method for manufacturing a semiconductor device according to the first embodiment.

As shown in FIG. 2A, a third groove 118 for forming an interconnect (hereinafter referred to as the "third interconnect formation groove 118) is formed in the fourth and fifth interlayer insulating films 116, 117 by using a lithography method and a dry etching method. Then, a second hole 119 for forming a via (hereinafter referred to as the "second via formation hole 119") connecting to the second interconnect 113 is formed in the second liner film 115 and the fourth interlayer insulating film 116 by using a lithography method and a dry etching method.

Figure 2B:
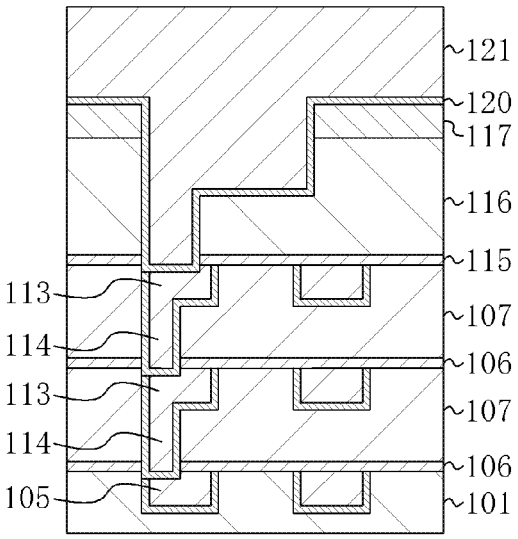

As shown in FIG. 2B, a Ta/TaN barrier film 120 and a copper film 121 are sequentially deposited over the entire surface of the fifth interlayer insulating film 117 including the third interconnect formation groove 118 and the second via formation hole 119, by using a sputtering method and a plating method. Note that although the stacked layer of the Ta and TaN films is used as the barrier film 120 in the present embodiment, a single-layer film or a stacked film, which is made of a Ta film, a Ti film, a Ru film, nitride films or alloys thereof, etc., may be used as the barrier film 120. Although copper (Cu) is used as a conductive film that is embedded in the third interconnect formation groove 118 and the second via formation hole 119, the present invention is not limited to Cu, and silver (Ag), aluminum (Al), alloys thereof, etc. may be used as the conductive film.

Figure 2C:
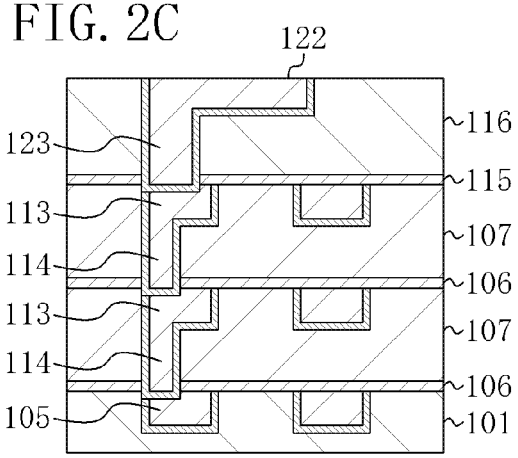

As shown in FIG. 2C, unwanted parts of the barrier film 120 and the copper film 121, which are deposited in the region other than the third interconnect formation groove 118 over the fifth interlayer insulating film 117, and the fifth interlayer insulating film 117 are removed by a CMP method, and the fourth interlayer insulating film 116 is polished by a thickness of about 20 nm. Thus, a third interconnect 122 and a second via 123, which are formed by the barrier film 120 and the copper film 121, are formed in the third interconnect formation groove 118 and the second via formation hole 119. The CMP method shown in FIG. 2C will be described in detail later with reference to FIGS. 4A-4D.

Figure 2D:
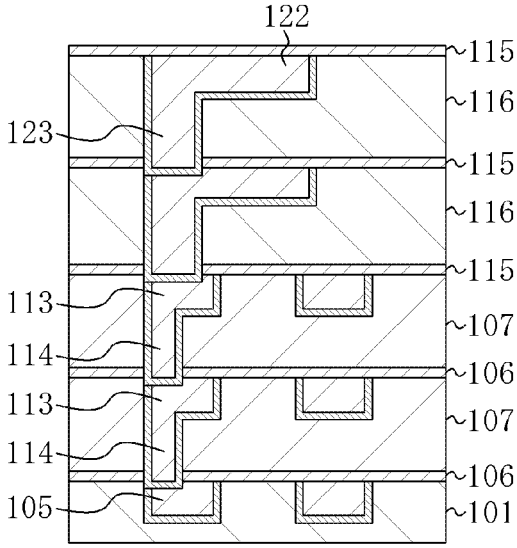

Subsequently, the steps of FIGS. 1I and 2A-2C are repeated to form a five-layer interconnect structure shown in FIG. 2D. Note that although the five-layer interconnect structure is formed by repeating the steps of FIGS. 1I and 2A-2C in the present embodiment, the number of interconnect layers of the interconnect structure is not limited to this.

Note that although the two kinds of interconnects, namely the interconnects formed by repeating the steps of FIGS. 1D-1G and the interconnects formed by repeating the steps of FIGS. 1I and 2A-2C, are used over the interconnects shown in FIG. 1C in the present embodiment, the number of kinds of interconnects is not limited to this.

The CMP method in the step of FIG. 1G will be described below with reference to FIGS. 3A-3D.

Figure 3A:
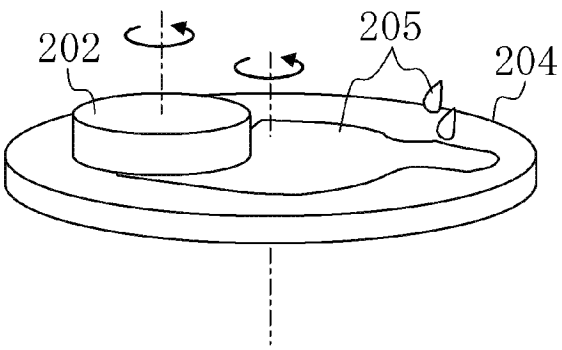
FIG. 3A is a perspective view showing a polishing apparatus that is used for lower-level interconnects according to the first embodiment.

First, a polishing apparatus and a polishing mechanism that are used for the CMP method will be described. In the CMP method, as shown in FIG. 3A, two places (hereinafter referred to as the "platens") for performing polishing are provided in a single apparatus.

A first polishing pad 201 is bonded to a first platen, and a wafer (not shown) is bonded to a polishing head 202. At this time, the wafer is bonded so that the surface of the wafer faces the first polishing pad 201. A pressure is applied to the polishing head 202 to press the wafer against the first polishing pad 201. During polishing, first slurry 203 is dropped onto the first polishing pad 201 to polish the contact surface of the wafer with the first polishing pad 201.

A second platen has a structure similar to that of the first platen, and a second polishing pad 204, which is different from that of the first platen, can be bonded to the second platen. Second slurry 205, which is different from that of the first platen, can be dropped onto the second polishing pad 204.

Note that although two platens are provided in a single apparatus in the present embodiment, the number of platens is not limited to this.

Figure 3B:
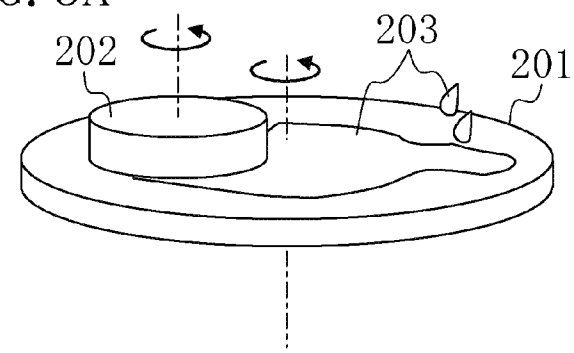
FIGS. 3B-3D are cross-sectional views illustrating polishing with the polishing apparatus in more detail.
Figure 3B:
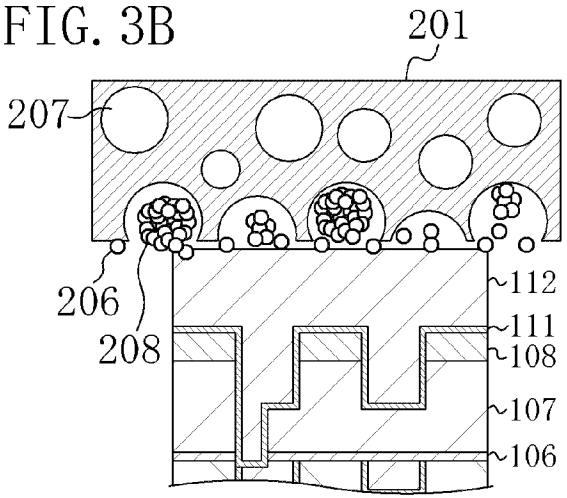
Figure 3C:
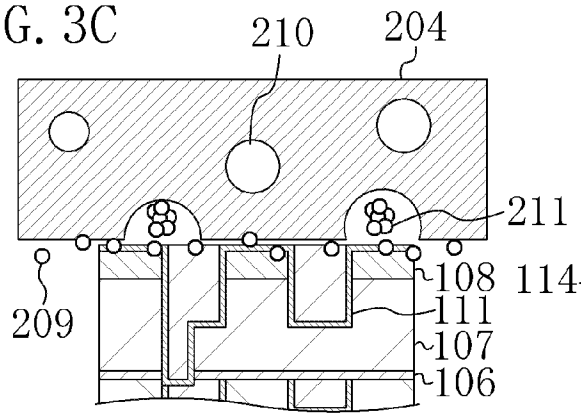
Figure 3D:
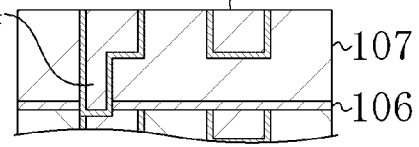

FIGS. 3B-3D are cross-sectional views when performing polishing with the polishing apparatus of FIG. 3A.

FIG. 3B shows a cross-sectional configuration during polishing on the first platen. In the first platen, an unwanted part of the copper film 112 is removed which is deposited in the region other than the second interconnect formation grooves (not shown) over the third interlayer insulating film 108. At this time, the first slurry 203 is used which contains hydrogen peroxide as an oxidizing agent, and a colloidal silica having a particle size of about 50 nm as abrasive particles. The colloidal silica is slightly acidic with a pH of 6.0.

As shown in FIG. 3B, polishing of the copper film 112 proceeds, and the copper film 112 is removed as the first polishing pad 201 is rubbed against the copper film 112 by using abrasive particles 206 in the first slurry 203 as a medium. The first polishing pad 201 has a plurality of pores 207 having a diameter of about 50 μm. During polishing, the first slurry 203 enters the pores 207. In the pores 207, the abrasive particles 206 gather to form first agglomerated abrasive particles 208. Since the barrier film 111 has higher hardness than the abrasive particles 206, no scratch is made on the barrier film 111 by the first agglomerated abrasive particles 208. On the other hand, since the copper film 112 has lower hardness than the abrasive particles 206, scratches are made on the copper film 112 by the first agglomerated abrasive particles 208. However, the copper film 112 is further polished when polishing the barrier film 111 as described below. Thus, the scratches on the copper film 112 are eventually removed. After the copper film 112 is removed, the wafer is transferred to the second platen via the polishing head 202.

FIG. 3C shows a cross-sectional configuration during polishing on the second platen. In the second platen, an unwanted part of the barrier film 111 is removed which is deposited in the region other than the second interconnect formation grooves (not shown) on the third interlayer insulating film 108. In the second platen, the third interlayer insulating film 108 is also removed, and the second interlayer insulating film 107 is polished by a thickness of about 20 nm. Thus, as shown in FIG. 3D, the second interconnects 113 and the first via 114 are formed in the second interlayer insulating film 107. At this time, the second slurry 205 is used which contains hydrogen peroxide as an oxidizing agent, and a colloidal silica having a particle size of about 50 nm and a colloidal silica having a particle size of about 100 nm as abrasive particles. The colloidal silicas are acidic with a pH of 3.0.

As shown in FIG. 3C, polishing proceeds, and the barrier film 111 is removed as the second polishing pad 204 is rubbed against the barrier film 111 by using abrasive particles 209 in the second slurry 205 as a medium. Polishing proceeds similarly for the third interlayer insulating film 108 and the second interlayer insulating film 107. Like the first polishing pad 201, the second polishing pad 204 has a plurality of pores 210 having a diameter of about 50 μm. Since the number of pores 210 in the second polishing pad 204 is smaller than that of pores 207 in the first polishing pad 201, the number of second agglomerated abrasive particles 211 that grow in the pores 210 of the second polishing pad 204 is smaller than that of first agglomerated abrasive particles 209 that grow in the pores 207 of the first polishing pad 201. Thus, polishing with the second polishing pad 204 having a smaller number of pores can significantly reduce the number of scratches as compared to polishing with the first polishing pad 201 having a larger number of pores. Note that the numbers of pores in the first and second polishing pads 201, 204 in this step will be described in detail later with reference to FIGS. 5A-5B.

The CMP method in the step of FIG. 2C will be described below with reference to FIGS. 4A-4D.

Figure 4A:
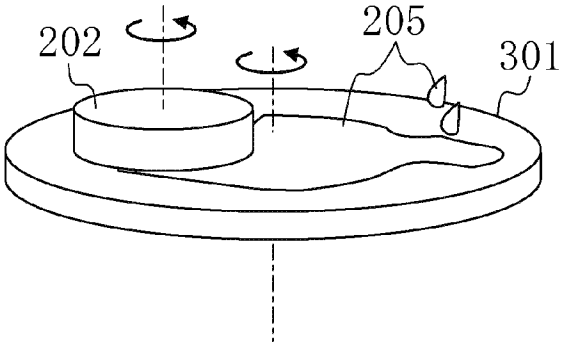
FIG. 4A is a perspective view showing a polishing apparatus that is used for upper-level interconnects according to the first embodiment.

First, a polishing apparatus and a polishing mechanism that are used for the CMP method will be described. In the CMP method, as shown in FIG. 4A, two places (hereinafter referred to as the "platens") for performing polishing are provided in a single apparatus.

A first polishing pad 201 is bonded to a first platen, and a wafer (not shown) is bonded to a polishing head 202. At this time, the wafer is bonded so that the surface of the wafer faces the first polishing pad 201. A pressure is applied to the polishing head 202 to press the wafer against the first polishing pad 201. During polishing, first slurry 203 is dropped onto the first polishing pad 201 to polish the contact surface of the wafer with the first polishing pad 201.

A second platen has a structure similar to that of the first platen, and a third polishing pad 301, which is different from that of the first platen, can be bonded to the second platen. Second slurry 205, which is different from that of the first platen, can be dropped onto the third polishing pad 301.

Note that although two platens are provided in a single apparatus in the present embodiment, the number of platens is not limited to this. Although the third polishing pad 301 that is different from the second polishing pad 204 used in the polishing step of FIG. 1G is used for the second platen in the present embodiment, the second polishing pad 204 may be used. Although the second slurry 205 used in the polishing step of FIG. 1G is used for the second platen in the present embodiment, the slurry that is used for the second platen need not necessarily be the same as that used in the polishing step of FIG. 1G.

Figure 4B:
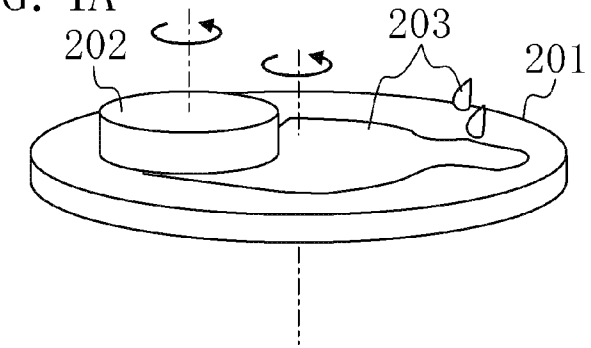
FIGS. 4B-4D are cross-sectional views illustrating polishing with the polishing apparatus in more detail.
Figure 4B:
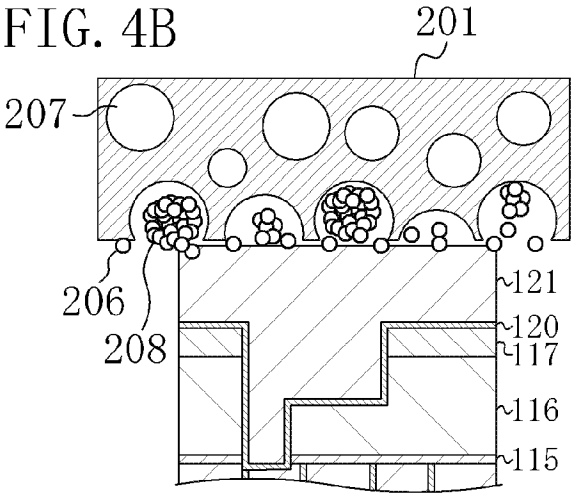
Figure 4C:
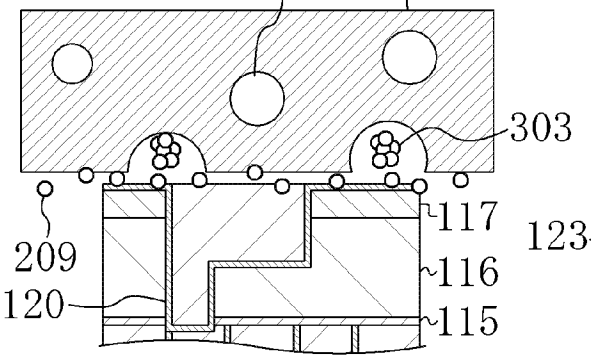
Figure 4D:
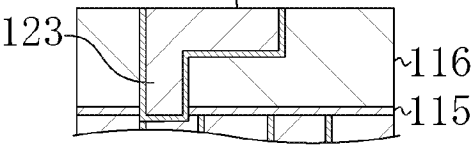

FIGS. 4B-4D are cross-sectional views when performing polishing with the polishing apparatus of FIG. 4A.

FIG. 4B shows a cross-sectional configuration during polishing on the first platen. In the first platen, an unwanted part of the copper film 121 is removed in a manner similar to that used to remove the unwanted part of the copper film 112 in FIG. 1G. Thus, detailed description thereof will be omitted. After the unwanted part of the copper film 121 is removed, the wafer is transferred to the second platen via the polishing head 202.

FIG. 4C shows a cross-sectional configuration during polishing on the second platen. In the second platen, an unwanted part of the barrier film 120 is removed which is deposited in the region other than the third interconnect formation groove (not shown) on the fifth interlayer insulating film 117. In the second platen, the fifth interlayer insulating film 117 is also removed, and the fourth interlayer insulating film 116 is polished by a thickness of about 20 nm. Thus, as shown in FIG. 4D, the third interconnect 122 and the second via 123 are formed in the fourth interlayer insulating film 116. At this time, the second slurry 205 is used which contains hydrogen peroxide as an oxidizing agent, and a colloidal silica having a particle size of about 50 nm and a colloidal silica having a particle size of about 100 nm as abrasive particles. The colloidal silicas are acidic with a pH of 3.0.

As shown in FIG. 4C, the barrier film 120 and the interlayer insulating film 117 shown in FIG. 2C are polished and removed. Like the first polishing pad 201, the third polishing pad 301 has a plurality of pores 302 having a diameter of about 50 μm. The number of pores 302 in the third polishing pad 301 is smaller than that of pores 207 in the first polishing pad 201. Thus, polishing with the third polishing pad 301 having a smaller number of pores can reduce the number of scratches as compared to polishing with the first polishing pad 201 having a larger number of pores. Note that the number of pores 302 in the third polishing pad 301 is larger than that of pores 210 in the second polishing pad 204 used in the polishing of FIG. 1G.

As described above, the number of third agglomerated abrasive particles 303 that grow in the pores 302 of the third polishing pad 301 is smaller than that of first agglomerated abrasive particles 209 that grow in the pores 207 of the first polishing pad 201. Moreover, the number of third agglomerated abrasive particles 303 that grow in the pores 302 of the third polishing pad 301 is larger than that of second agglomerated abrasive particles 211 that grow in the pores 210 of the second polishing pad 204. That is, although the number of third agglomerated abrasive particles 303 is larger than that of second agglomerated abrasive particles 211 that grow in the pores 210 of the second polishing pad 204 in the polishing of FIG. 1G, scratches are less likely to be made on the fourth interlayer insulating film 116 as the fourth interlayer insulating film 116 has higher hardness than the second interlayer insulating film 107. Thus, the number of scratches can be reliably reduced even though the number of third agglomerated abrasive particles 303 is larger than that of second agglomerated abrasive particles 211.

Thus, the third polishing pad 301, which has a smaller number of pores than the first polishing pad 201 that is used to remove the copper film, is used to remove an insulating film having relatively high hardness (that is, having a relatively high dielectric constant or a relatively low porosity), because scratches are naturally less likely to be made on such an insulating film. Moreover, in order to maintain the polishing rate and high throughput, it is preferable to use the third polishing pad 301 having a larger number of pores than the second polishing pad 304 that is used to remove an insulating film having relatively low hardness (that is, having a relatively low dielectric constant or a relatively high porosity). It should be noted that as the number of pores in the pad is reduced, the amount of the slurry component that enters the pores is reduced, and the polishing rate is reduced. On the other hand, as the number of pores in the pad is increased, the amount of the slurry component that enters the pores is increased, and the polishing rate is increased.

The numbers of pores in the first and third polishing pads 201, 301 in this step, together with the number of pores in the second polishing pad 204, will be described in detail below with reference to FIGS. 5A-5B.

The numbers of pores in the polishing pads used in the polishing steps of FIGS. 3A-3D and 4A-4D will be described below. As used herein, the "number of pores" is derived from the "pore area ratio" described below.

Figure 5A:
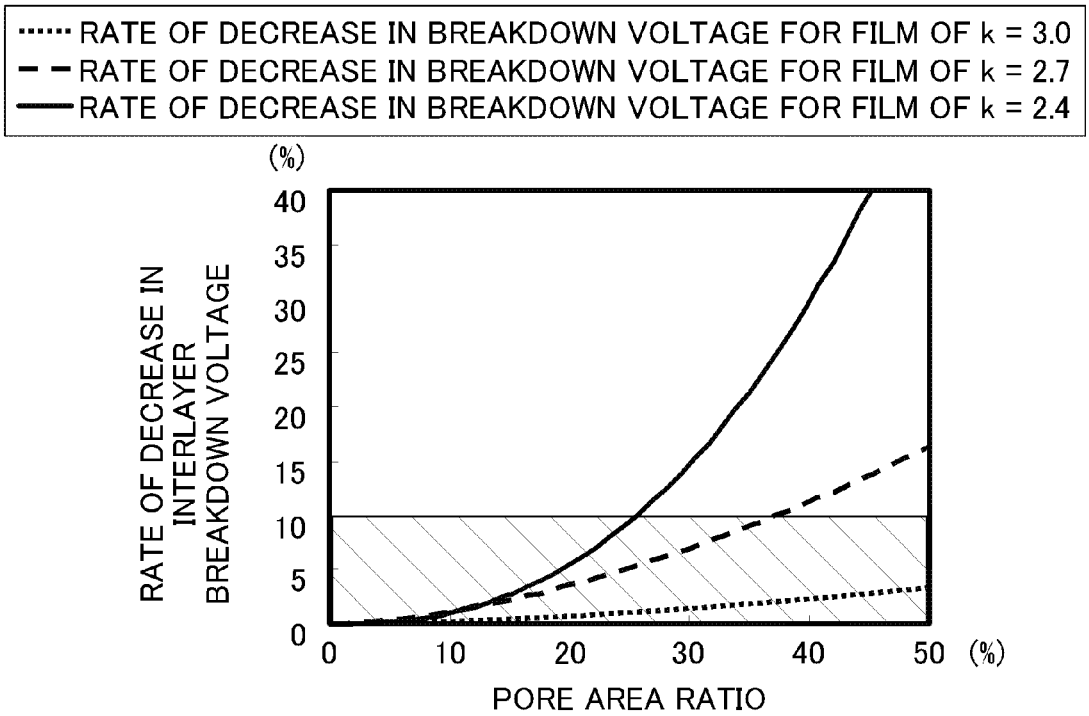
FIGS. 5A-5B are graphs showing the result of polishing experimentation according to the first embodiment.

FIG. 5A shows the result of dependency of the interlayer breakdown voltage on the pore area ratio of the polishing pad when three kinds of interlayer insulating films having different relative dielectric constants were polished. As used herein, the "interlayer breakdown voltage" refers to electric field strength at the time an insulating film that is deposited on a silicon semiconductor substrate breaks down by a voltage that is applied to the semiconductor substrate and the insulating film. The "pore area ratio" of the polishing pad refers to the proportion of the area of the wafer that does not contact the polishing pad when the polishing pad contacts the wafer. The result of FIG. 5A shows that the lower the relative dielectric constant is, the more the interlayer breakdown voltage decreases. Moreover, the lower the pore area ratio of the polishing pad is, the more the amount of decrease in interlayer breakdown voltage can be reduced. This result indicates that when using an insulating film having a low relative dielectric constant as the interlayer insulating film, the pore area ratio of the polishing pad should be reduced in order to implement a higher operation speed and lower power consumption of semiconductor devices.

Figure 5B:
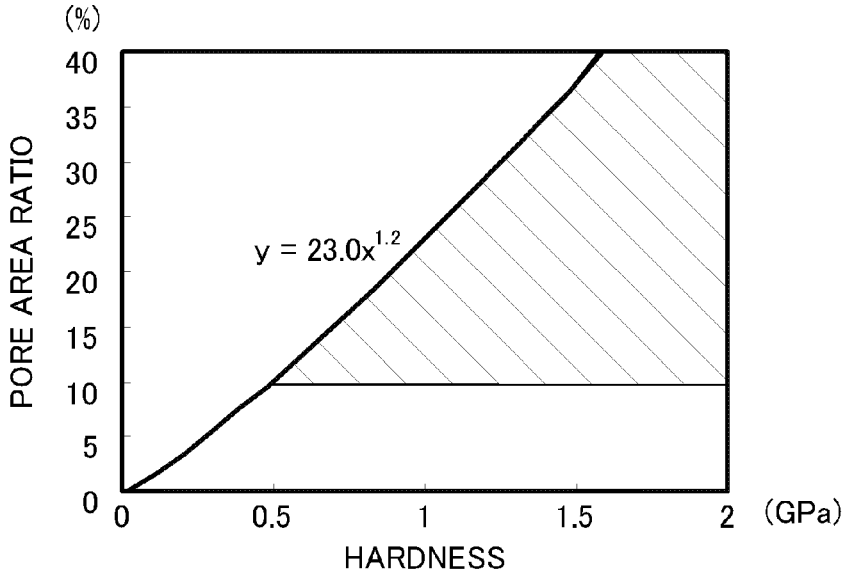

The shaded portion in FIG. 5B shows the relation between the hardness of the interlayer insulating film and the pore area ratio of the polishing pad when reducing the rate of decrease in interlayer breakdown voltage to 10% or less. This relates to the shaded portion in FIG. 5A. Specifically, as shown in FIG. 5A, if the interlayer insulating film has a dielectric constant of 2.4, the pore area ratio should be about 26% in order to achieve the rate of decrease in interlayer breakdown voltage of 10%. The hardness of the interlayer insulating film is between about 1.0 GPa and about 1.1 GPa, both inclusive, when the interlayer insulating film has a dielectric constant of 2.4. As shown in FIG. 5A, if the interlayer insulating film has a dielectric constant of 2.7, the pore area ratio should be about 37% in order to achieve the rate of decrease in interlayer breakdown voltage of 10%. The hardness of the interlayer insulating film is between about 1.4 GPa and about 1.5 GPa, both inclusive, when the interlayer insulating film has a dielectric constant of 2.7. As shown in FIG. 5B, a curve corresponding to the rate of decrease in interlayer breakdown voltage of 10% can be plotted by using a large number of such data values. This curve can be represented by "$y=23\times x^{1.2}$," where "y" represents the pore area ratio, and "x" represents the hardness of the interlayer insulating film. Note that in the specification, this equation is equivalent to the expression "the pore area ratio 'y' is equal to '23×(hardness [GPa] of the interlayer insulating film) ^1.2' percent." If the interlayer insulating film has a dielectric constant of 3.0, the hardness thereof is between about 2.5 GPa and about 2.6 GPa, both inclusive.

According to this result, it is desirable that the polishing pad that is used to polish the interlayer insulating film in the step of FIG. 3C or 4C have a pore area ratio of "23×(hardness [GPa] of the interlayer insulating film) ^1.2" percent or less. This is because it is desirable to reduce the rate of decrease in interlayer breakdown voltage to at least 10% or less in order to maintain reliability of semiconductor devices. However, if the pore area ratio is too low, the polishing rate is reduced due to a reduced amount of the slurry component entering the pores. Thus, it is desirable that the polishing pad that is used to polish the interlayer insulating film in the step of FIG. 3C or 4C have a pore area ratio of 10% or more. The result of FIG. 5A also shows that the interlayer insulating films having a relative dielectric constant of about 3.0 or more, or more than about 3.0 have smaller dependency on the pore area ratio of the polishing pad. Thus, it is preferable to limit the dependency of the interlayer insulating films having a relative dielectric constant of about 3.0 or less, or less than about 3.0, on the pore area ratio of the polishing pad.

The pore area ratio of the polishing pad that is used to polish the copper film in the step of FIG. 3B or 4B will be described below. When polishing the copper film, no scratch can be made on the barrier film because the colloidal silica as abrasive particles contained in the first slurry 203 is softer than the barrier film. Scratches are made on the copper film because the copper film is softer than the colloidal silica. However, when subsequently polishing the barrier film and the interlayer insulating film, the copper film is polished to a depth greater than that of the scratches made by polishing the copper film. Thus, these scratches are eventually removed. This means that the pore area ratio of the polishing pad that is used to polish the copper film need not be so low as that of the polishing pad that is used to polish a film having a low relative dielectric constant. However, if the polishing pad has an excessively high pore area ratio, the polishing rate is reduced, and the polishing pad wears excessively, due to a small contact area between the polishing pad and the wafer. Thus, it is desirable that the polishing pad that is used to polish the copper film in the step of FIG. 3B or 4B have a pore area ratio of 90% or less. On the other hand, if the polishing pad has an excessively low pore area ratio, the polishing rate is reduced due to a reduced amount of the slurry component entering the pores. In polishing the copper film, the dependency of the polishing rate on the oxidizing agent in the slurry is greater than that in polishing the barrier film and the interlayer insulating film. Thus, it is desirable that the polishing pad have a pore area ratio of "23×(hardness [GPa] of the insulating film) ^1.2" percent or more.

As described above, in the method for manufacturing a semiconductor device by using the polishing pads according to the first embodiment, the pore area ratio of the polishing surface of the second polishing pad 204 for polishing and removing the barrier film and the insulating film is made lower than that of the polishing surface of the first polishing pad 201 for polishing and removing the metal film such as the copper film. This can prevent scratches on the second interlayer insulating film 107.

It is preferable to use as the insulating film a low dielectric constant (low-k) film having a relative dielectric constant of about 3.0 or less, or less than about 3.0. The use of such a low-k film reduces the capacitance between interconnects, whereby semiconductor devices capable of operating at a high speed with low power consumption can be obtained.

It is preferable that the pore area ratio of the polishing surface of the polishing pad for polishing and removing the barrier film and the insulating film be between 10 percent and "23×(hardness [GPa] of the insulating film) ^1.2" percent, both inclusive. The use of such a polishing pad can prevent scratches, whereby reliable semiconductor devices can be obtained.

It is preferable that the pore area ratio of the polishing surface of the polishing pad for polishing and removing the metal film be between "23×(hardness [GPa] of the insulating film) ^1.2" percent and 90 percent, both inclusive. The use of such a polishing pad reduces wear of the polishing pad, whereby semiconductor devices can be manufactured at low cost.

It is preferable that the insulating film be formed by a first insulating film having a relative dielectric constant of more than about 3.0 as an upper layer, and a second insulating film having a relative dielectric constant of about 3.0 or less, or less than about 3.0 as a lower layer. Forming the insulating film having a high relative dielectric constant as the upper layer can reduce processing damage, such as damage that is caused when depositing a mask such as a hard mask or a resist mask, and damage that is caused when depositing a barrier metal film.

In polishing the insulating film, it is preferable to polish and remove the entire first insulating film having a high relative dielectric constant as the upper layer, because removing the insulating film having a high relative dielectric constant can further reduce the capacitance between interconnects.

As described above, the method for manufacturing a semiconductor device by using the polishing pads according to the first embodiment can prevent scratches, whereby the manufacturing yield and reliability of semiconductor devices can be increased.

Second Embodiment

The method for manufacturing a semiconductor device according to the present invention, namely the polishing method of the present invention, is also applicable to polishing of oxide films (e.g., a silicon oxide film). FIGS. 6A-6D show cross-sectional configurations illustrating polishing of an interlayer insulating film in the steps of FIGS. 1C-1D in the manufacturing process of the semiconductor device shown in FIGS. 1A-1I.

Figure 6A:
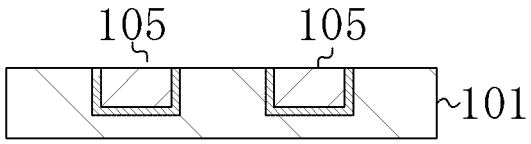
FIGS. 6A-6D are cross-sectional views illustrating the steps of a method for manufacturing a semiconductor device according to a second embodiment.

The step of FIG. 6A is the same as that of FIG. 1C, and the manufacturing process before the step of FIG. 6A is also the same.

Figure 6B:
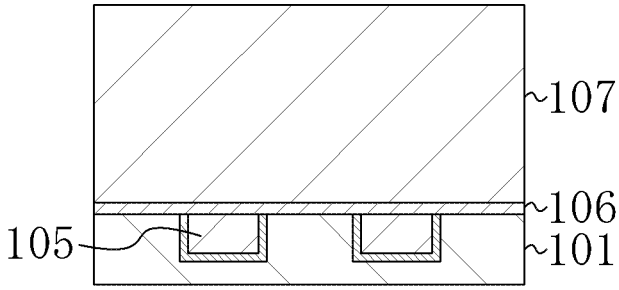

As shown in FIG. 6B, a first liner film 106, which is made of SiCN and has a thickness of about 50 nm, is formed over the entire surface including the first interlayer insulating film 101 and the first interconnects 105, by using, e.g., a CVD method. Then, a second interlayer insulating film 107, which is made of SiOC and has a thickness of about 300 nm, is formed on the first liner film 106. Note that in the present embodiment, a SiOC film including pores and having a relative dielectric constant of about 3.0 or less, or less than about 3.0 is preferably used as the second interlayer insulating film 107 made of SiOC. The lower the relative dielectric constant of the second interlayer insulating film 107 is, the more the capacitance between interconnects can be reduced. Thus, higher speed operation and lower power consumption of semiconductor devices can be implemented.

Figure 6C:
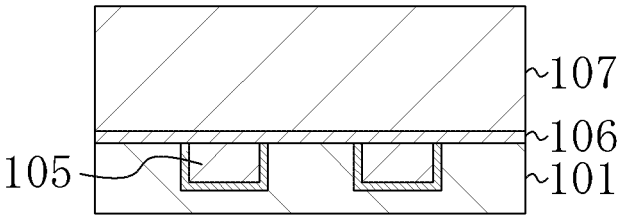

As shown in FIG. 6C, the second interlayer insulating film 107 is polished by a thickness of about 100 nm by a CMP method. The polishing in this step will be described in detail later with reference to FIGS. 7A-7D.

Figure 6D:
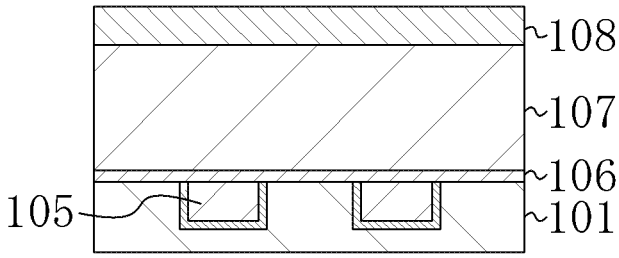

Then, as shown in FIG. 6D, a third interlayer insulating film 108, which is made of $SiO_2$ and has a thickness of about 100 nm, is formed on the second interlayer insulating film 107. Although the third interlayer insulating film 108 made of $SiO_2$ is used in the present embodiment, the third interlayer insulating film 108 may be an insulating film made of SiOC having a relative dielectric constant of about 3.0 or more, or more than 3.0, or a stacked film of $SiO_2$ and SiOC. When used as a hard mask for processing, the third interlayer insulating film 108 made of $SiO_2$ may be a stacked film that is formed by stacking a metal film such as TiN or TaN on an insulating film of $SiO_2$ or SiOC. The subsequent manufacturing process is the same as the manufacturing process that is performed after the step of FIG. 1D.

The CMP method in the step of FIG. 6C will be described below with reference to FIGS. 7A-7D.

Figure 7A:
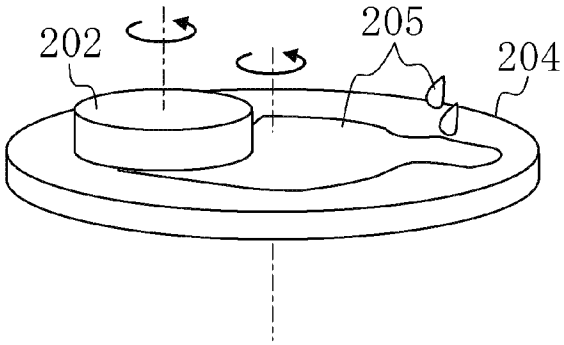
FIG. 7A is a perspective view showing a polishing apparatus that is used for lower-level interconnects according to the second embodiment.

First, a polishing apparatus and a polishing mechanism that are used for the CMP method will be described. In the CMP method, as shown in FIG. 7A, two places (hereinafter referred to as the "platens") for performing polishing are provided in a single apparatus.

A first polishing pad 201 is bonded to a first platen, and a wafer (not shown) is bonded to a polishing head 202. At this time, the wafer is bonded so that the surface of the wafer faces the first polishing pad 201. A pressure is applied to the polishing head 202 to press the wafer against the first polishing pad 201. During polishing, first slurry 203 is dropped onto the first polishing pad 201 to polish the contact surface of the wafer with the first polishing pad 201.

A second platen has a structure similar to that of the first platen, and a second polishing pad 204, which is different from that of the first platen, can be bonded to the second platen. Second slurry 205, which is different from that of the first platen, can be dropped onto the second polishing pad 204.

Note that although two platens are provided in a single apparatus in the present embodiment, the number of platens is not limited to this.

Figure 7B:
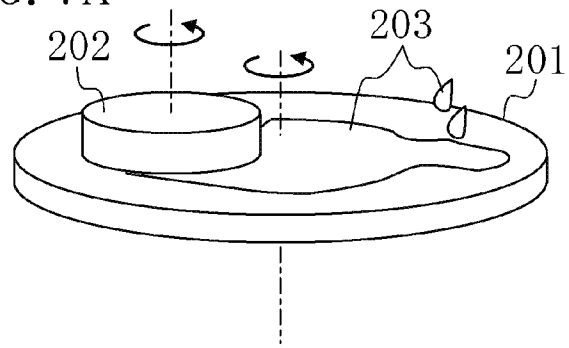
FIGS. 7B-7D are cross-sectional views illustrating polishing with the polishing apparatus in more detail.
Figure 7B:
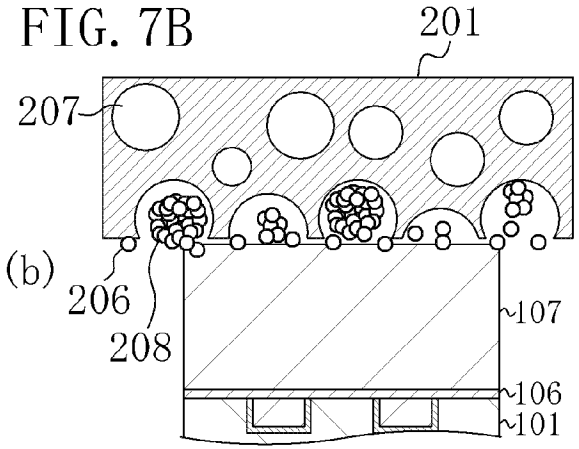
Figure 7C:
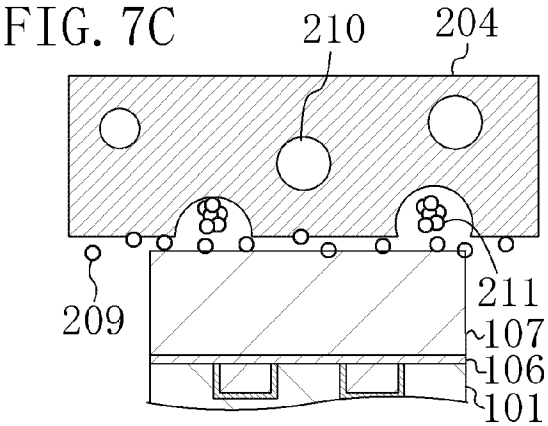
Figure 7D:
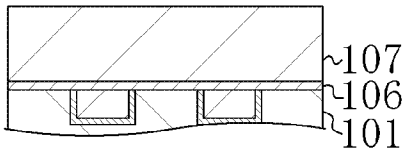
Figure 8:
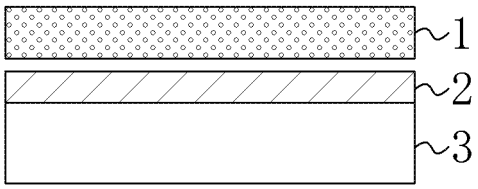
FIG. 8 PRIOR ART
FIG. 8 is a cross-sectional view of a polishing pad of a conventional example.
Figure 9A:
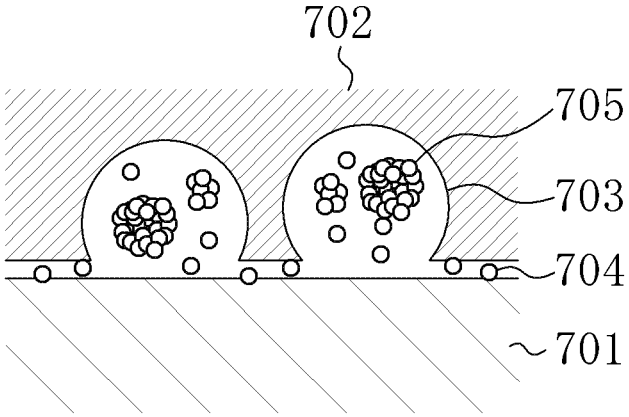
FIG. 9A PRIOR ART
FIGS. 9A-9B are cross-sectional views illustrating problems that are caused by polishing in the conventional example.
Figure 9B:
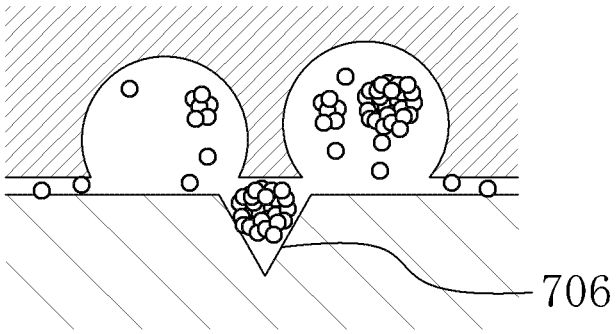
FIG. 9B PRIOR ART

FIGS. 7B-7D are cross-sectional views when performing polishing with the polishing apparatus of FIG. 7A.

FIG. 7B shows a cross-sectional configuration during polishing on the first platen. In the first platen, the second interlayer insulating film 107 is polished and removed by a thickness of about 50 nm. At this time, the first slurry 203 is used which contains hydrogen peroxide as an oxidizing agent, and a colloidal silica having a particle size of about 50 nm and a colloidal silica having a particle size of about 100 nm as abrasive particles. The colloidal silicas are acidic with a pH of 3.0.

As shown in FIG. 7B, polishing of the second interlayer insulating film 107 proceeds, and the second interlayer insulating film 107 is removed as the first polishing pad 201 is rubbed against the second interlayer insulating film 107 by using abrasive particles 206 in the first slurry 203 as a medium. The first polishing pad 201 has a plurality of pores 207 having a diameter of about 50 μm. During polishing, the first slurry 203 enters the pores 207. In the pores 207, the abrasive particles 206 gather to form first agglomerated abrasive particles 208. Scratches are made on the second interlayer insulating film 107 by the first agglomerated abrasive particles 208. However, the second interlayer insulating film 107 is further polished in the second polishing step of polishing the second interlayer insulating film 107 as described below. Thus, the scratches on the second interlayer insulating film 107 are eventually removed. After the second interlayer insulating film 107 is removed by a thickness about 50 nm, the wafer is transferred to the second platen via the polishing head 202.

FIG. 7C shows a cross-sectional configuration during polishing on the second platen. In the second platen, the second interlayer insulating film 105 is polished and removed by a thickness of about 50 nm, as shown in FIG. 7C. Thus, as shown in FIG. 7D, the finished second interlayer insulating film 107 has a thickness of about 200 nm. At this time, the second slurry 205 is used which contains hydrogen peroxide as an oxidizing agent, and a colloidal silica having a particle size of about 50 nm and a colloidal silica having a particle size of about 100 nm as abrasive particles. The colloidal silicas are acidic with a pH of 3.0. Like the first polishing pad 201, the second polishing pad 204 has a plurality of pores 210 having a diameter of about 50 μm. Since the number of pores 210 in the second polishing pad 204 is smaller than that of pores 207 in the first polishing pad 201, the number of second agglomerated abrasive particles 211 that grow in the pores 210 is smaller than that of first agglomerated abrasive particles 209 that grow in the pores 207. Thus, the number of scratches can be reduced. Note that the numbers of pores in the first and second polishing pads 201, 204 in this step will be described in detail later with reference to FIGS. 5A-5B.

FIG. 5A shows the result of dependency of the interlayer breakdown voltage on the pore area ratio of the polishing pad when three kinds of interlayer insulating films having different relative dielectric constants were polished. As described earlier, the lower the relative dielectric constant is, the more the interlayer breakdown voltage decreases. Moreover, the lower the pore area ratio of the polishing pad is, the more the amount of decrease in interlayer breakdown voltage can be reduced. This result indicates that when using an insulating film having a low relative dielectric constant as the interlayer insulating film, the pore area ratio of the polishing pad should be reduced in order to implement a higher operation speed and lower power consumption of semiconductor devices.

The shaded portion in FIG. 5B shows the relation between the hardness of the interlayer insulating film and the pore area ratio of the polishing pad when reducing the rate of decrease in interlayer breakdown voltage to 10% or less. This relates to the shaded portion in FIG. 5A. Specifically, as shown in FIG. 5A, if the interlayer insulating film has a dielectric constant of 2.4, the pore area ratio should be about 26% in order to achieve the rate of decrease in interlayer breakdown voltage of 10%. The hardness of the interlayer insulating film is between about 1.0 GPa and about 1.1 GPa, both inclusive, when the interlayer insulating film has a dielectric constant of 2.4. As shown in FIG. 5A, if the interlayer insulating film has a dielectric constant of 2.7, the pore area ratio should be about 37% in order to achieve the rate of decrease in interlayer breakdown voltage of 10%. The hardness of the interlayer insulating film is between about 1.4 GPa and about 1.5 GPa, both inclusive, when the interlayer insulating film has a dielectric constant of 2.7. As shown in FIG. 5B, a curve corresponding to the rate of decrease in interlayer breakdown voltage of 10% can be plotted by using a large number of such data values. This curve can be represented by "$y=23\times x^{1.2}$," where "y" represents the pore area ratio, and "x" represents the hardness of the interlayer insulating film. Note that if the interlayer insulating film has a dielectric constant of 3.0, the hardness thereof is between about 2.5 GPa and about 2.6 GPa, both inclusive.

According to this result, it is desirable that the polishing pad that is used to polish the interlayer insulating film in the step of FIG. 7C have a pore area ratio of "23×(hardness [GPa] of the interlayer insulating film) ^1.2" percent or less. However, if the pore area ratio is too low, the polishing rate is reduced due to a reduced amount of the slurry component entering the pores. Thus, it is desirable that the polishing pad that is used to polish the interlayer insulating film in the step of FIG. 3C have a pore area ratio of 10% or more. The result of FIG. 5A also shows that the interlayer insulating films having a relative dielectric constant of about 3.0 or more, or more than about 3.0 have smaller dependency on the pore area ratio of the polishing pad. Thus, it is preferable to limit the dependency of the interlayer insulating films having a relative dielectric constant of about 3.0 or less, or less than about 3.0, on the pore area ratio of the polishing pad.

The pore area ratio of the polishing pad that is used to polish the interlayer insulating film in the step of FIG. 7B will be described below. In the first stage of the polishing of the interlayer insulating film, namely in the first polishing of the interlayer insulating film, scratches are made on the interlayer insulating film because the colloidal silicas as abrasive particles contained in the first slurry 203 are harder than the interlayer insulating film. However, in the subsequent stage of the polishing of the interlayer insulating film, namely in the second polishing of the interlayer insulating film, the interlayer insulating film is polished to a depth greater than that of the scratches made on the interlayer insulating film. Thus, these scratches are eventually removed. This means that the pore area ratio of the polishing pad that is used for the first polishing of the interlayer insulating film need not be so low as that of the polishing pad that is used for the second polishing of the interlayer insulating film. However, if the polishing pad has an excessively high pore area ratio, the polishing rate is reduced, and the polishing pad wears excessively, due to a small contact area between the polishing pad and the wafer. Thus, it is desirable that the polishing pad that is used for the first polishing of the interlayer insulating film in the step of FIG. 7B have a pore area ratio of 90% or less. On the other hand, if the polishing pad has an excessively low pore area ratio, the polishing rate is reduced due to a reduced amount of the slurry component entering the pores. In the first polishing of the interlayer insulating film, it is desirable that the polishing pad have a pore area ratio of "23×(hardness [GPa] of the insulating film) ^1.2" percent or more.

As described above, in the method for manufacturing a semiconductor device by using the polishing pads according to the second embodiment, in the case where the step of polishing the second interlayer insulating film 107 includes the first polishing step and the second polishing step, the pore area ratio of the polishing surface of the second polishing pad 204 for polishing and removing the second interlayer insulating film 107 in the second polishing step is made lower than that of the polishing surface of the first polishing pad 201 for polishing and removing the second interlayer insulating film 107 in the first polishing step. Thus, the polishing rate is maintained by the first polishing step, and scratches on the second interlayer insulating film 107 can be prevented by the second polishing step. Such a polishing method is especially effective when the second interlayer insulating film 107 has large surface irregularities.

It is preferable to use as the insulating film a low-k film having a relative dielectric constant of about 3.0 or less, or less than about 3.0. The use of such a low-k film reduces the capacitance between interconnects, whereby semiconductor devices capable of operating at a high speed with low power consumption can be obtained.

It is preferable that the pore area ratio of the polishing surface of the second polishing pad 204 for polishing and removing the second interlayer insulating film 107 in the second polishing step be between 10 percent and "23×(hardness [GPa] of the insulating film) ^1.2" percent, both inclusive. The use of such a polishing pad can prevent scratches, whereby reliable semiconductor devices can be obtained.

It is preferable that the pore area ratio of the polishing surface of the first polishing pad 201 for polishing and removing the second interlayer insulating film 107 in the first polishing step be between "23×(hardness [GPa] of the insulating film) ^1.2" percent and 90 percent, both inclusive. The use of such a polishing pad reduces wear of the polishing pad, whereby semiconductor devices can be manufactured at low cost.

As described above, in the method for manufacturing a semiconductor device by using the polishing pads according to the second embodiment, if, e.g., the lower layer in the interlayer insulating film has large surface irregularities, the low-k film is directly polished to reduce the possibility that surface irregularities may be formed in the lower layer. This can reduce the possibility that defective openings may be formed in the lithography process, whereby manufacturing yield of semiconductor devices can be increased. Moreover, since scratches on the low-k film can be prevented, the manufacturing yield and reliability of the semiconductor devices can be increased.

Since the method for manufacturing a semiconductor device according to the present invention can prevent scratches on a low-k film having low hardness, the manufacturing yield and reliability of semiconductor devices can be increased. The method for manufacturing a semiconductor device according to the present invention is especially useful for methods for manufacturing a semiconductor device including a polishing method that is used to form an insulating film or to form interconnects in the insulating film.

What is claimed is:

1. A method for manufacturing a semiconductor device, comprising step of:

forming a groove in an insulating film, the insulating film being formed over a semiconductor substrate;

forming a barrier film and a metal film sequentially over the insulating film after forming the groove;

performing a first chemical mechanical polishing (CMP), with a first polishing pad, on the metal film to remove a portion of the metal film in a region other than the groove; and performing a second CMP, with a second polishing pad, on the barrier film and the insulating film to remove a portion of the barrier film in the region other than the groove and an upper portion of the insulating film, wherein:

a pore area ratio of a polishing pad is defined as a proportion, represented in percent, of an area of a wafer that does not contact the polishing pad to a total area of the wafer, a polishing surface of the first polishing pad has a first pore area ratio and a polishing surface of the second polishing pad has a second pore area ratio, and the first pore area ratio is larger than the second pore area ratio.

2. The method of claim 1, wherein the second pore area ratio is equal to or more than 10 percent and equal to or less than $23X^{1.2}$ percent, where X is hardness of the insulating film in a GPa unit.

3. The method of claim 1, wherein the first pore area ratio is equal to or more than $23X^{1.2}$ percent and equal to or less than 90 percent, where X is hardness of the insulating film in a GPa unit.

4. The method of claim 1, wherein the insulating film has a relative dielectric constant of 3.0 or less.

5. The method of claim 1, wherein the insulating film is formed by a first insulating film having a relative dielectric constant of more than 3.0 as an upper layer, and a second insulating film having a relative dielectric constant of 3.0 or less as a lower layer.

6. The method of claim 5, wherein the entire first insulating film is polished and removed in the step of performing the second CMP.

7. A method for manufacturing a semiconductor device, comprising step of:

forming an insulating film over a semiconductor substrate;

performing a first chemical mechanical polishing (CMP), with a first polishing pad, on the insulating film to remove an upper portion of the insulating film;

performing a second CMP, with a second polishing pad which is different from the first polishing pad, on the insulating film, after the step of performing the first CMP, wherein:

a pore area ratio of a polishing pad is defined as a proportion, represented in percent, of an area of a wafer that does not contact the polishing pad to a total area of the wafer, a polishing surface of the first polishing pad has a first pore area ratio and a polishing surface of the second polishing pad has a second pore area ratio, and the first pore area ratio is larger than the second pore area ratio.

8. The method of claim 7, wherein the second pore area ratio is equal to or more than 10 percent and equal to or less than $23X^{1.2}$ percent, where X is hardness of the insulating film in a GPa unit.

9. The method of claim 7, wherein the first pore area ratio is equal to or more than $23X^{1.2}$ percent and equal to or less than 90 percent, where X is hardness of the insulating film in a GPa unit.

10. The method of claim 7, wherein the insulating film has a relative dielectric constant of 3.0 or less.

* * * * *